US007914079B2

(12) United States Patent
Link

(10) Patent No.: US 7,914,079 B2
(45) Date of Patent: Mar. 29, 2011

(54) HEAD AND/OR NECK SUPPORT

(75) Inventor: Werner Link, Messstetten (DE)

(73) Assignee: Interstuhl Bueromoebel GmbH & Co. KG, Messstetten (DE)

( * ) Notice: Subject to any disclaimer, the term of this patent is extended or adjusted under 35 U.S.C. 154(b) by 158 days.

(21) Appl. No.: 12/365,442

(22) Filed: Feb. 4, 2009

(65) Prior Publication Data

US 2009/0200851 A1 Aug. 13, 2009

(30) Foreign Application Priority Data

Feb. 13, 2008 (DE) ..... 10 2008 008 961

(51) Int. Cl.
*A47C 7/36* (2006.01)

(52) U.S. Cl. ..... 297/408

(58) Field of Classification Search ..... 297/408, 297/409, 410, 391
See application file for complete search history.

(56) References Cited

U.S. PATENT DOCUMENTS

| | | | | |
|---|---|---|---|---|
| 2,632,497 | A | 3/1953 | Brady | |
| 3,477,761 | A * | 11/1969 | Krantz | 297/409 |
| 3,761,128 | A | 9/1973 | Schenk et al. | |
| 4,335,920 | A | 6/1982 | Hirth | |
| 5,177,823 | A * | 1/1993 | Riach | 5/636 |
| 5,971,485 | A * | 10/1999 | Clark | 297/423.12 |
| 6,397,414 | B1 * | 6/2002 | Lloyd | 5/622 |
| 6,718,582 | B1 * | 4/2004 | Tinsley | 5/640 |
| 7,044,555 | B2 * | 5/2006 | Saberan | 297/408 |
| 7,832,803 | B2 * | 11/2010 | Cassaday | 297/408 |

FOREIGN PATENT DOCUMENTS

| | | |
|---|---|---|
| BE | 692 661 | 7/1967 |
| DE | 1 227 189 | 10/1966 |
| DE | 2 326 255 | 3/1974 |
| DE | 42 26 153 | 2/1994 |
| GB | 2012570 A * | 8/1979 |
| JP | 2000288042 | 10/2000 |
| JP | 2001-233307 | 8/2001 |
| JP | 2002011058 | 1/2002 |

* cited by examiner

*Primary Examiner* — Milton Nelson, Jr.
(74) *Attorney, Agent, or Firm* — Michael J. Striker

(57) ABSTRACT

A head and/or neck support for a chair, in particular for an office chair, includes a device for adjusting the swivel and height, with which the support may be moved relative to a back rest of the chair, a first receptacle for a head and/or neck cushion, and a second receptacle for fastening the support to the back rest, the support being rotatably held at one end on the second receptacle via two first swivel arms and on the other end, the first swivel arms being connected in a rotatable and swivelable manner to two second swivel arms which hold the first receptacle at the end which is opposite the swivel arms which are hingedly connected to one another.

7 Claims, 2 Drawing Sheets

HEAD AND/OR NECK SUPPORT

CROSS-REFERENCE TO RELATED APPLICATION

The invention described and claimed hereinbelow is also described in German Patent Application DE 10 2008 008 961.3 filed on Feb. 13, 2008. This German Patent Application, whose subject matter is incorporated here by reference, provides the basis for a claim of priority of invention under 35 U.S.C. 119(a)-(d).

BACKGROUND OF THE INVENTION

The present invention relates to a head and/or neck support of a chair, in particular of an office chair, the support including a device for adjusting the swivel and height, with which the support may be moved relative to a back rest of the chair. The support includes a first receptacle for a head and/or neck cushion, and a second receptacle for fastening the support to the back rest.

Various embodiments of height-adjustable head supports which include neck cushions having an adjustable tilt are already known. Few head and neck supports also allow an adjustment of the extent to which the neck cushion extends forward or backward relative to the back rest. In addition, most of the known head and neck supports are difficult to adjust and lock in the desired position while the user is seated.

SUMMARY OF THE INVENTION

The object of the present invention is to provide a head and/or neck support which makes it easy to carry out any two-dimensional adjustment of the neck cushion.

The object is attained using a head and/or neck support of a chair, in particular of an office chair, according to which the support includes a device for adjusting the swivel and height, using which the support may be moved relative to a back rest of the seat. The support also includes a first receptacle for a head and/or neck cushion, and a second receptacle for fastening the support to the back rest. The head and/or neck support is characterized by the fact that the support is rotatably held at one end on the second receptacle via two first swivel arms, and, at the other end, the first swivel arms are connected in a rotatable and swivelable manner to two second swivel arms which hold the first receptacle at the end which is opposite the hingedly-connected swivel arms.

The head and/or neck support according to the present invention therefore includes two pair of hingedly-connected swivel arms, the first pair of swivel arms being rotatably and swivelably connected to the receptacle for fastening the support to the back rest. The cushion is mounted on the free ends of the second pair of swivel arms. The head and/or neck support may therefore be moved into any position within the swivel range of the two pair of swivel arms in a stepless manner or in detent stages, thereby making it possible to meet the individual needs of the chair user in an optimal manner.

Further advantages result when the first receptacle on which the neck cushion is mounted is held on the second swivel arms in a manner such that it may rotate about a first axis. Once the main position of the cushion has been set, the cushion may adapt to the shape and motion of the head and neck which are resting thereon. The comfort of the head and/or neck support is further increased as a result.

To ensure simple usability of the head and/or neck support, the first receptacle may include a release and locking device for releasing and locking a swivel and rotational motion of the hinged connection between the first and second swivel arms, and for releasing and locking a rotational motion of the first swivel arms relative to the second receptacle. In this embodiment, it is possible to move the support entirely in any direction using a single release and locking device, and to subsequently fix it in the desired position. The release and locking device is also easy to operate, since it is located on the receptacle for the head and/or neck cushion.

The release and locking device is particularly easy to operate when it includes a release lever which is swivelably supported on the first receptacle, is manually actuatable at one end, and is connected at the other end to means which lock the connections between the swivel arms, and between the first swivel arms and the second receptacle, or which release them for motion. With the aid of a single lever which may be operated at one end using pressure, the chair may therefore be released from its current position and moved into the desired new position, where it may be locked in position simply by releasing the release lever. It is therefore possible for the user to operate the head support easily while seated.

The means for locking and releasing the motion of the head support may preferably include a spring-loadable cable which extends through the interior of the swivel arms and a first connection section between the first swivel arms. With the aid of this cable which extends through the swivel arms, it is possible to open and lock both articulation points simultaneously, i.e. the articulation point between the first pair of swivel arms and the second receptacle, and the articulation point between the two pair of swivel arms.

Various possibilities exist for locking the head support in position. In a preferred embodiment, the rotational motions at the joint between the swivel arms, and at the joint between the first swivel arms and the second receptacle may take place via engageable and disengageable ring gear connections. When the ring gears are engaged, the head support is locked in position. As soon as the ring gears become disengaged, the head support may be moved freely.

For locking, it is also advantageous when the cable is under spring-loaded tension when the joints are in the fixed, rigid state. Using this embodiment, it is possible to slacken the cable by swiveling the release lever. A spring located in the joint between the swivel arms, and a spring located in the joint between the first swivel arms and the second receptacle disengage the ring gears situated therein and enable the rotational motions to be carried out. The locking may be realized using ring gears, multitooth shafts, or splined shafts.

It is also advantageous when the spring force of the first spring which tightens the cable is greater than the sum of the spring forces of all springs that take effect in the support, and is preferably greater than the friction forces that act on the cable. It is also advantageous that the cable is tightened when the release lever is in the resting position. In this manner, all necessary motions of the cable and the elements connected thereto may be realized using a minimum number of springs.

A preferred embodiment of a head and/or neck support according to the present invention is explained below in greater detail with reference to the drawing.

DESCRIPTION OF THE PREFERRED EMBODIMENTS

Figure 1:
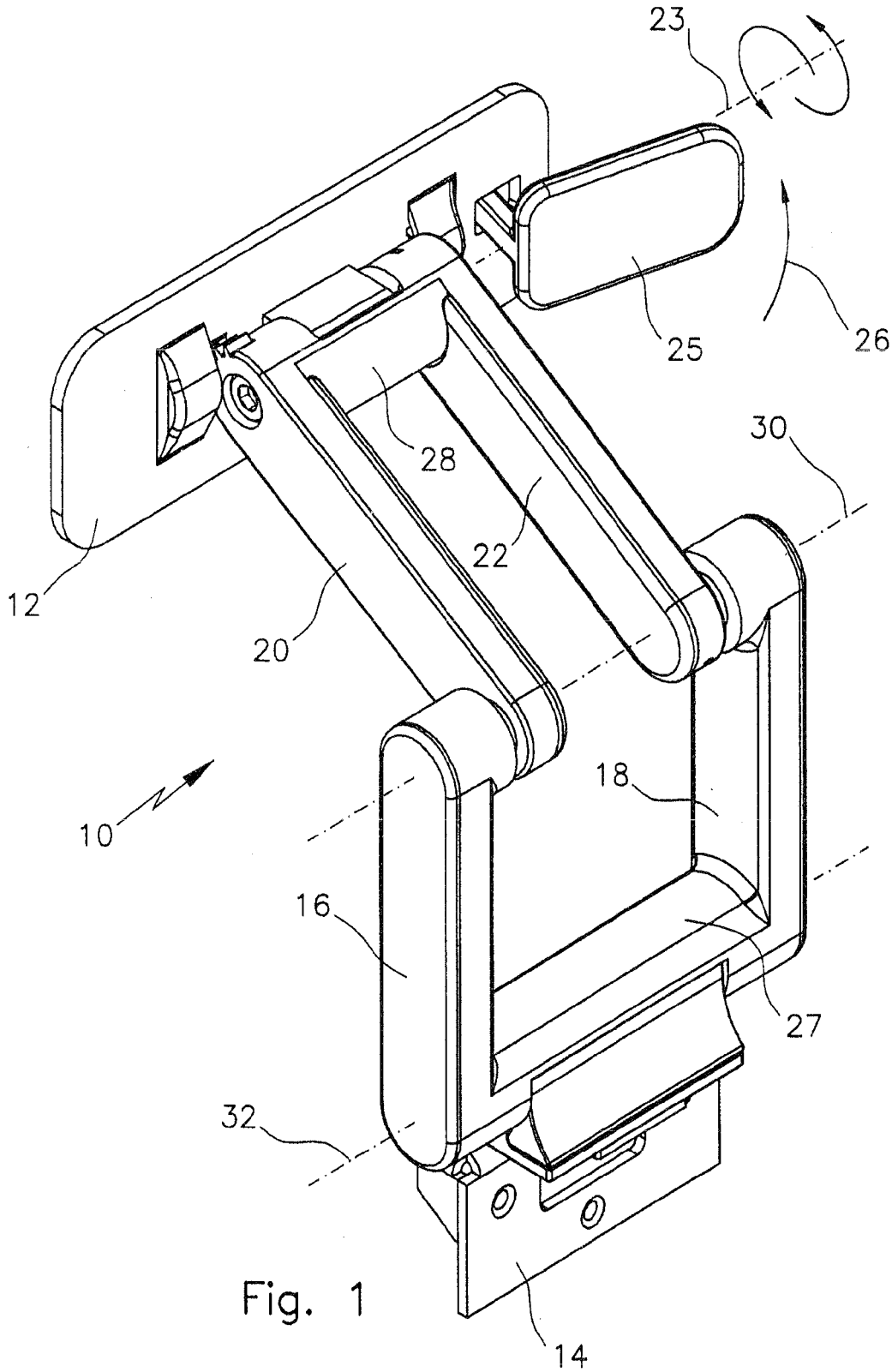
FIG. 1 shows a perspective back-side view of a head and/or neck support according to the present invention.

Head and/or neck support 10 shown in FIG. 1 includes a first receptacle 12 for a head and neck cushion which is not depicted here. In addition, a second receptacle 14 is provided, using which support 10 may be attached to the back rest of a chair which is not depicted here. Receptacle 14 is designed in a manner such that it may be attached to practically any type of back rest using screws. This design of receptacle 14 also makes it possible to attach support 10 to a back rest at a later point in time. Receptacle 14 may be covered entirely by a back rest cushion.

First swivel arms 16, 18 and second swivel arms 20, 22 are located between receptacles 14 and 12. First swivel arms 16, 18 are connected to one another via a connection piece 27, and, together therewith, they form a U-shaped component. Connection piece 27 defines an axis 32. Swivel arms 16, 18 are attached to receptacle 14 in a manner such that they may swivel about axis 32. In addition, first swivel arms 16, 18 are connected to second swivel arms 20, 22 in a manner such that they may swivel about an axis 30. First receptacle 12 for the neck cushion is supported at the ends of swivel arms 20, 22 in a manner such that it may swivel about an axis 23. The free ends of second swivel arms 20, 22 are connected to one another via a connection piece 28 on which first receptacle 12 is hingedly supported, and which forms a second U-shaped component together with swivel arms 20, 22.

An appropriate mechanism is provided for releasing and locking the position of support 10, i.e. a release lever 25 shown in FIG. 1 is located on the back side of receptacle 12, and is swivelable in arrow direction 26. Support 10 is locked in position in the non-actuated state of lever 25 shown. Pressing lever 25 allows support 10 to be swiveled, as described below in greater detail with reference to FIG. 2.

Figure 2:
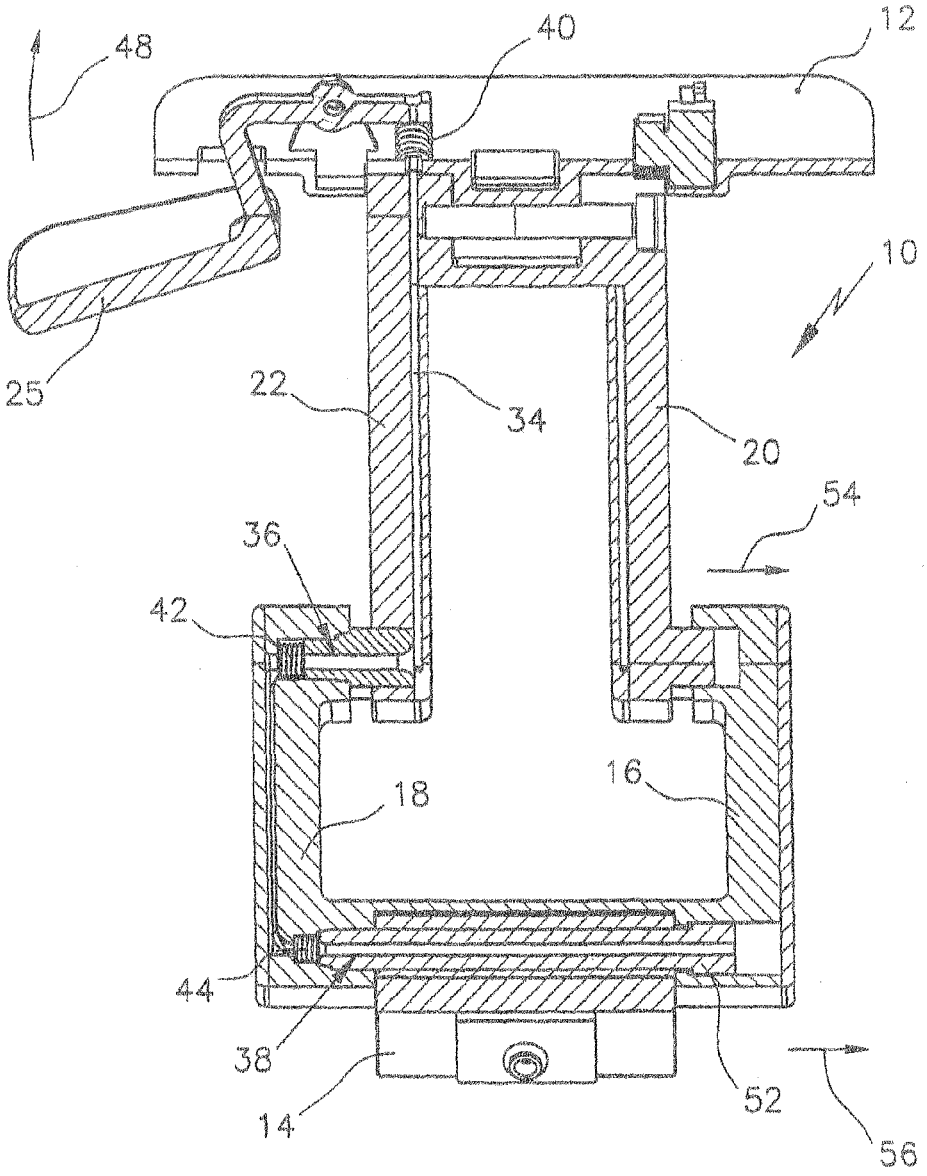
FIG. 2 shows a central longitudinal view through the head and/or neck support in FIG. 1.

The sectional view in FIG. 2 shows a cable 34 which is situated in the interior of swivel arms 18, 20 and connection piece 27. Cable 34 is attached via one end to swivel lever 25 and extends through a first spring 40. A further spring 42 is provided at the articulation point between swivel arms 18 and 22, and a further spring 44 is provided at the articulation point between swivel arm 18 and receptacle 14. Springs 42 and 44 act on respective ring gear connections 36, 38 which are shown schematically in the figure, provided they are engaged with one another as shown, and lock swivel arm 22 in position relative to swivel arm 18, and swivel arm 18 relative to receptacle 14. Cable 34 extends through all ring gear connections 36, 38 and springs 42, 44, and is attached via one end to a cylindrical component 52 which is displaceably supported in connection piece 27. If pressure is now applied to release lever 25 in arrow direction 48, first spring 40 is compressed, thereby relieving the tension on cable 34. Via this slackening, springs 42, 44 are also able to slacken, thereby pressing swivel arms 22, 20 in arrow direction 54, and pressing cylindrical component 52 in arrow direction 56. The result is that ring gear connections 36, 38 become disengaged. Support 10 is now free to move, and it may be swiveled into the desired position. As soon as this position has been reached, release lever 25 is released, thereby relieving the tension on spring 40 and tightening second and third springs 42, 44. Ring gear connections 36, 38 engage with one another and lock support 10 in position.

It will be understood that each of the elements described above, or two or more together, may also find a useful application in other types of constructions differing from the types described above.

While the invention has been illustrated and described as embodied in a head and/or neck support, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A support of a chair for a head, a neck, or both, of a user, said chair having a hank rest, said support comprising a device for adjusting a swivel and a height of the support relative to the back rest of the chair;

a first receptacle for a cushion for supporting the head, the neck, or both;

a second receptacle for attaching the support to the back rest;

two first swivel arms rotatably connected to said second receptacle at one end of the support;

two second swivel arms holding the first receptacle for the cushion at another end of said support opposite from said one end thereof, said two second swivel arms being pivotally connected in a rotatable and swivelable manner to said two first swivel arms respectively;

a locking and releasing device for locking and releasing a rotational motion of the second swivel arms relative to the first swivel arms and for locking and releasing a rotational motion of the first swivel arms relative to the second receptacle;

an engageable and disengageable ring gear connection for providing rotational motion at a pivot joint between the second swivel arms and the first swivel arms; and an engageable and disengageable ring gear connection for providing rotation motion at a pivot joint between the first swivel arms and the second receptacle;

whereby the support is adjustable in order to attain a predetermined position for supporting the head, the neck, or both of the user and is then lockable in the predetermined position.

2. The support as defined in claim 1, wherein said first receptacle is connected with the second swivel arms so as to be rotatable around a rotation axis.

3. The support as defined in claim 1, wherein said locking and releasing device includes a release lever that is pivotally supported on said first receptacle, that is manually actuable, and that is connected to means for engaging and disengaging said ring gear connection between the second swivel arms and the first swivel arms and means for engaging and disengaging to said ring gear connection between said first swivel arms and said second receptacle.

4. The support as defined in claim 3, wherein said means for engaging and disengaging said ring gear connections comprises a spring-loaded cable extending through an interior of said swivel arms and a connection section between said first swivel arms and said second swivel arms, wherein said spring-loaded cable is connected with said release lever and said ring gear connections so as to lock or release said ring gear connections when said release lever is operated.

5. The support as defined in claim 4, wherein said spring-loaded cable is under spring tension in a fixed and locked state of the support.

6. The support as defined in claim 5, wherein said spring tension on said cable is releasable by operation of said release lever, so as to cause a spring at the pivot joint between said swivel arms and a spring at the pivot joint between said first swivel arm and said second receptacle to disengage said ring gear connections situated therein and enable rotational motions.

7. The support as defined in claim 1, configured for an office chair.

* * * * *